US006046417A

United States Patent [19]

Menze

[11] Patent Number: 6,046,417

[45] Date of Patent: Apr. 4, 2000

[54] MEMBRANE SUPPORTED AND ACTUATED SWITCHING MECHANISM

[75] Inventor: Peter C. Menze, Marquette, Mich.

[73] Assignee: M.P. Menze Research & Development, Inc., Marquette, Mich.

[21] Appl. No.: 09/227,915

[22] Filed: Jan. 8, 1999

[51] Int. Cl.[7] ..... H01H 3/02

[52] U.S. Cl. ..... 200/330; 200/294; 200/296; 200/332.1; 200/512

[58] Field of Search ..... 200/5 A, 512–517, 200/83 N, 83 Z, 293–296, 302.1, 302.2, 330

[56] References Cited

U.S. PATENT DOCUMENTS

| | | | |
|---|---|---|---|
| 4,250,434 | 2/1981 | Valansot | 200/83 Z |
| 4,300,029 | 11/1981 | Maser | 200/83 N X |
| 4,394,547 | 7/1983 | Larson | 200/5 A |
| 4,397,082 | 8/1983 | Petersen | 29/622 |
| 4,433,223 | 2/1984 | Larson et al. | 200/159 |
| 4,596,905 | 6/1986 | Fowler | 200/5 A |
| 4,623,768 | 11/1986 | Gnant | 200/5 A |
| 4,818,827 | 4/1989 | Ipcinski et al. | 200/5 A |
| 4,977,298 | 12/1990 | Fujiyama | 200/5 A |
| 4,987,275 | 1/1991 | Miller et al. | 200/5 A |
| 5,081,328 | 1/1992 | Friend et al. | 200/81.9 R |
| 5,228,562 | 7/1993 | Burk | 200/512 |
| 5,294,762 | 3/1994 | Kaisu et al. | 200/513 |
| 5,491,314 | 2/1996 | Dorsey | 200/313 |
| 5,607,048 | 3/1997 | Kaizu et al. | 200/314 |
| 5,818,174 | 10/1998 | Ohara et al. | 315/169 |

*Primary Examiner*—J. R. Scott

*Attorney, Agent, or Firm*—Daniel G. Chapik; Craig J. Lervick; Oppenheimer Wolff & Donnelly LLP

[57] ABSTRACT

The present invention is a membrane switch. The membrane switch includes a switch assembly having a switch frame coupled to the switch assembly. The switch frame is sandwiched between various layers of the membrane, thus holding it in place. The lower surface of the membrane is coated with an adhesive. Once installed in an electronic device, the adhesive layer secures the membrane as well as the switch assembly in place. The adhesive layer serves to form a waterproof barrier between the membrane and the switch assembly.

6 Claims, 3 Drawing Sheets

MEMBRANE SUPPORTED AND ACTUATED SWITCHING MECHANISM

BACKGROUND OF THE INVENTION

Field of the Invention

The present invention relates generally to switches and more specifically to membrane-actuated miniature switch assemblies.

The trend of most modern electronic devices is to reduce both the size and the cost of the components and the device as a whole. As such, even the most rudimentary elements must undergo a physical redesign to account for this trend. In addition to attempting to reduce the size of these components, there is also a desire to minimize their obtrusiveness in any particular device. Bulky knobs and switches are often unpleasant to the eye and may not even be functional in certain environments. Finally, switches used in many commercial applications are often repeatably and forcibly engaged. That is, the switches are subjected to abusive usage, which eventually leads to damage. Thus, there is a desire to provide a switch which can withstand this type of use over a relatively long period of time.

In recognition of the above attributes, membrane switches were developed and have become quite common. In general, a membrane switch comprises a pliable membrane, usually having two layers. The upper layer usually will have a metal plate or some other type of electrical contact in it. When the top layer is depressed, it contacts the lower layer and the electrical contact bridges the ends of various terminals embedded in the lower layer thus closing or actuating the switch.

There exists a need to provide a membrane switch capable of carrying high current loads, thus reducing the overall size and complexity of various electronic devices. Due to the nature and the physical dimensions of the present membrane switches, they are prohibited from carrying large current loads. Consequently, these are not well suited to those applications which carry large currents. As such, if the switch activates a device which requires a large current load the membrane switch must act as an initial switch and a secondary or booster switch must be incorporated into the device. When so used, the membrane switch actuates the booster switch, and the booster switch engages the electronic device. This increases the number of components required to make the electronic device thus increasing the cost and complexity of it.

SUMMARY OF THE INVENTION

The present invention provides a membrane actuator for a miniature or sub-miniature switch assembly. The switch assembly is coupled to the membrane so that the switch actuator is in contact with an upper layer of the membrane. In one embodiment, the switch assembly has a metal frame. The metal frame surrounds a perimeter of the switch assembly. This frame is then secured between the two layers of the membrane itself and held in place with an adhesive. By depressing the upper layer of the membrane, the membrane contacts the actuator of the switch assembly and opens or closes the switch. The lower surface of the lower layer of the membrane is coated with an adhesive. This adhesive serves to hold the membrane and the switch in place within the electronic device. Furthermore, the adhesive coating serves to waterproof the entire switch assembly.

An advantage of using this type of membrane switch is that the entire assembly can be dropped into a prefabricated hole or opening in the electronic device or in a control panel of some type. The switch assembly itself has standard terminals protruding from it which can be connected in the known way. This type of assembly is significantly easier to install than traditional membrane switches which require additional structural and electrical support. Furthermore, this type of membrane switch can be retrofitted into current electronic devices. This effectively provides a mechanical solution to the traditionally electrical problem that membrane switches were limited to low current loads.

OBJECTS OF THE INVENTION

It is an object of the present invention to provide a membrane switch which can carry high current loads.

It is a further object of the invention to provide a membrane switch which is self-supporting.

It is yet another object of the invention to provide a membrane switch which, when installed, is waterproof.

It is still another object of the invention to provide a membrane switch which can be used with a variety of preexisting micro, miniature, and sub-miniature switch assemblies.

DETAILED DESCRIPTION OF PREFERRED EMBODIMENTS

Figure 1:
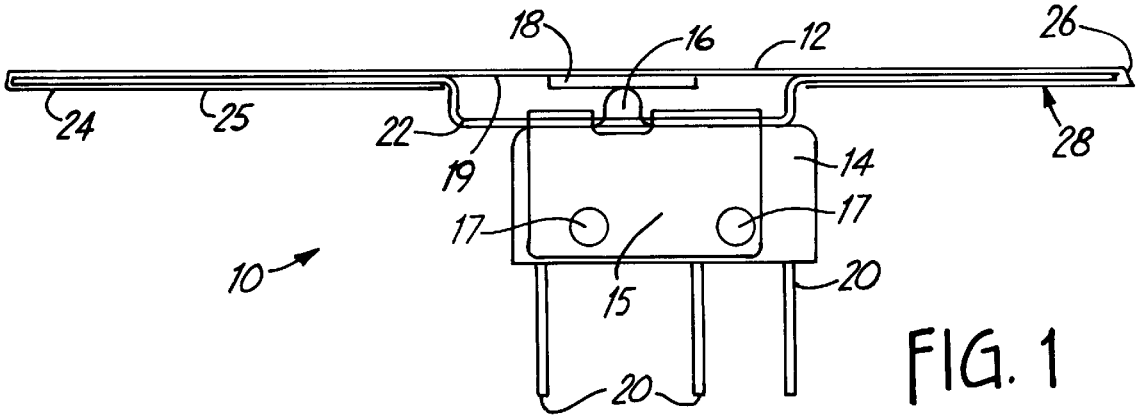
FIG. 1 is a side planar view of the membrane and switch assembly.
Figure 2:
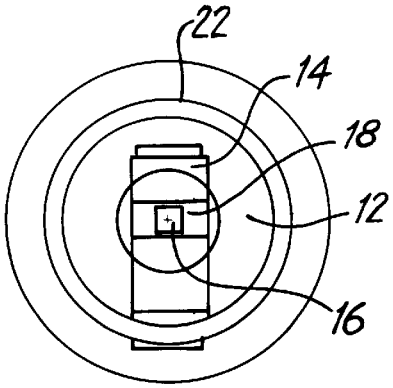
FIG. 2 is a top view of the membrane and switches assembly.
Figure 3:
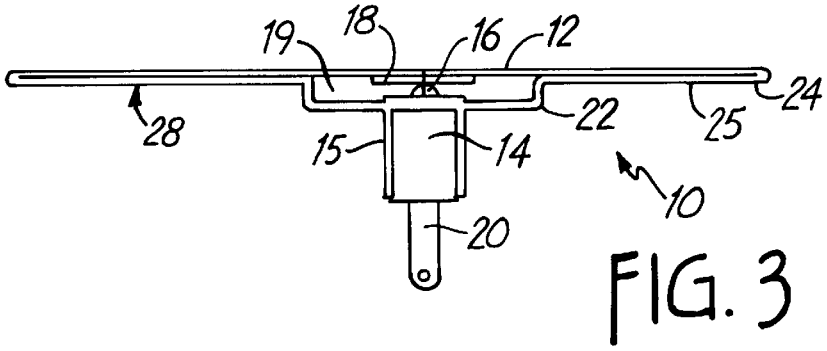
FIG. 3 is a side planar view of the membrane and switch assembly.

Turning now to FIGS. 1–3, the present invention will be described in detail. The membrane switch 10 has a switch assembly 14 having standard terminals 20. The terminals 20 are configured in a known way to produce the standard switching arrangements. While not meant to be limiting, the present invention uses, by way of example, a Cherry E-Series Sub-Miniature Switch, Model E62 (10.1 amp). A switch frame 22 is coupled to the switch 14 by a mounting bracket 15 that includes fasteners 17. The switch frame 22 protrudes from the switch 14. The various components of the switch can be made from any suitable material, including plastic or steel.

An upper membrane layer 12 is provided which has an engagement plate 18 located on its underside. Engagement plate 18 is optional and serves to ease the engagement of the switch 10 and also extends the life of the membrane 12, by reducing wear. A lower membrane layer 24 is also provided. A first adhesive layer 26 is placed between the upper and lower membrane layers (12, 24), thus sandwiching them together. Alternatively, layer 26 may simply be a filler. In that case each membrane layer would bear its own adhesive. Switch frame 22 is inserted between these two layers and thus is held in place by the adhesive 26 as well as the joinder of the two membrane layers. Switch assembly 14 passes through an opening 19 in lower membrane 24.

The underside 25 of the lower membrane layer 24 is coated with a second adhesive layer 28 of various types. For example, the second adhesive layer 28 may be a pressure-sensitive adhesive which may be applied when the switch 10 is manufactured. The use of such an adhesive is desirable because it will remain in place for long periods of time without breaking down. Thus, when the switch 10 is meant to be installed the pressure-sensitive adhesive will bond appropriately. Alternatively, adhesive may be applied to the underside 25 of the membrane just prior to installation of the switch. By applying the adhesive at this time, various types of fast setting or liquid adhesive may be used. In either case, adhesive layer 28 should be applied such that when the switch 10 is installed, the lower membrane 24 and adhesive 28 form a waterproof seal.

Figure 4:
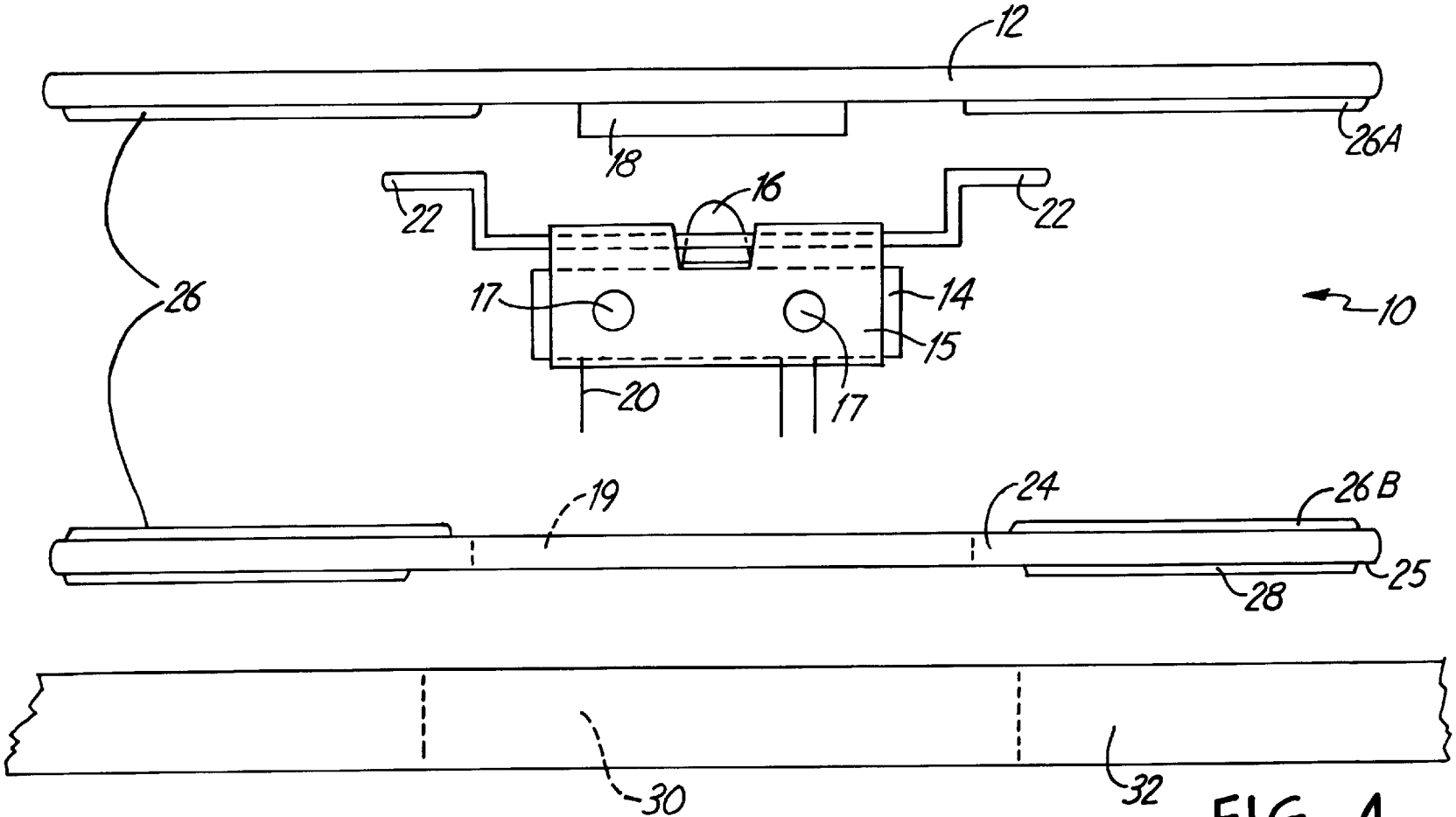
FIG. 4 is a partially sectional side view of the separated components of the switch assembly.
Figure 5:
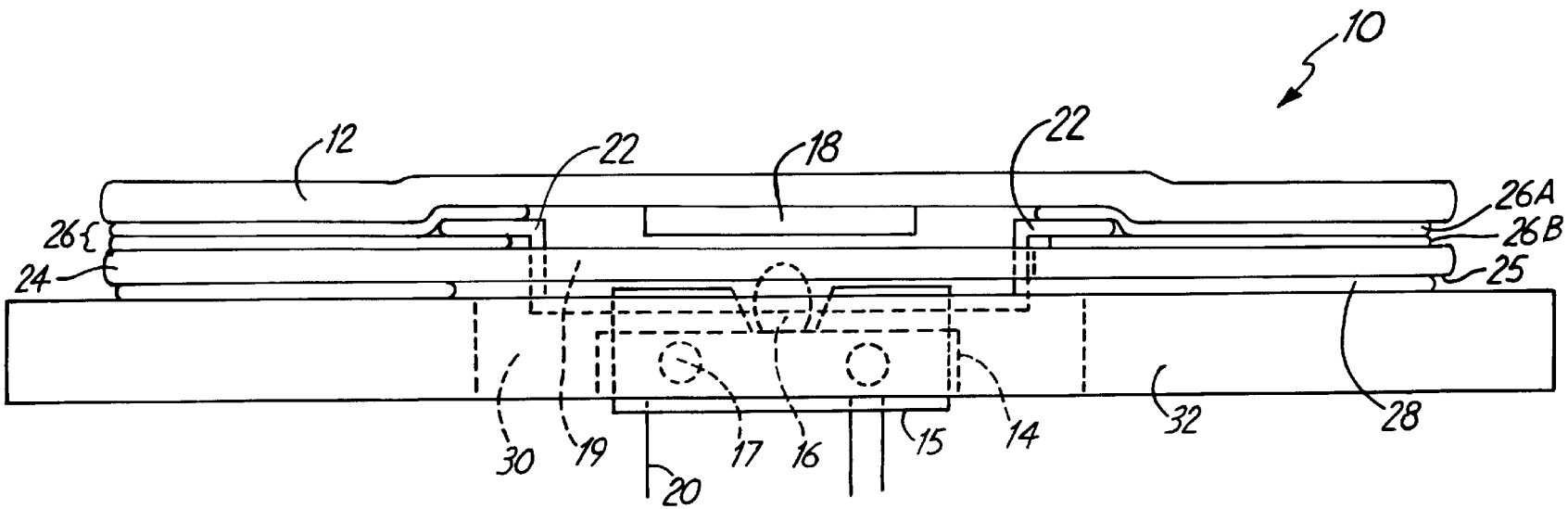
FIG. 5 is a partially sectional side view of the components of the switch assembly installed through a casing.

In use, a hole 30, is cut through the outer casing 32 of the electronic device to which the switch 10 is to be installed as shown in FIGS. 4 and 5. If the second adhesive layer 28 has not yet been applied, it is applied at this time. Then the switch assembly 14 is moved through the hole 30 in the electronic device. The various electrical connections can be made to terminals 20 at this time, or if access is permitted, the connections can be made after the switch is installed.

Subsequently, the underside 25 of the lower membrane portion 24 is caused to engage the casing 32 of the electronic device. The adhesive layer 28 then bonds to this casing 32 forming a waterproof seal, holding the switch 10 in place. To engage the switch 10, the upper surface of the membrane is depressed. This causes the engagement plate 18 to contact the switch actuator 16 of the switch assembly 14, thus selectively opening and closing the switch 10.

With reference to FIGS. 4 and 5, the particular embodiment shown includes upper membrane 12 and lower membrane 24. First adhesive layer 26 includes a greatly exaggerated upper adhesive layer 26A and a lower adhesive layer 26B, applied to upper membrane 12 and lower membrane 24 respectively. When assembled (FIG. 5), switch frame 22 is adhered between portions of upper adhesive layer 26A and lower adhesive layer 26B. The remainder of upper adhesive layer 26A and lower adhesive layer 26B contact and adhere to one another, binding upper membrane 12 to lower membrane 24. The flexibility of upper membrane 12 allows it to comply when depressed so that engagement plate 18 is able to contact and depress switch actuator 16.

Alternatively, first adhesive layer 26 could be formed solely from either upper adhesive layer 26A or lower adhesive layer 26B. In that case, the single adhesive layer 26A or 26B would contact both the switch frame 22 (on one side) and the opposing membrane (12 or 24). The switch frame 22 would be held in place by its one-sided adhesive contact as well as by the fact that the two membranes (12, 24) would be secured to one another, thus preventing the switch frame 22 from moving away from the adhesive layer 26. With either the illustrated or the discussed embodiment, switch frame 22 is sandwiched between upper membrane 12 and lower membrane 24, which are also adhered to one another.

In use, current flows through the terminals 20 of the switch assembly 14 but never through any portion of the membrane layers (12, 24). Thus, the amperage limitations of the previous membrane switches have been eliminated. Any amperage restriction in the switch of the present invention would be based solely on the capabilities of the switch assembly 14. This is advantageous as it is common to find various miniature or sub-miniature switch actuators which are capable of carrying a high current load. While any size switch could be used, including low current switches, the present switch is particularly useful in high current situations, namely those above 100 miliamps.

This type of switch assembly has many practical commercial applications. For instance, juke boxes are often placed in various dining or drinking establishments. Due to the nature of these establishments, the juke box is usually subjected to various foreign substances. It is not uncommon for people to spill drinks or food onto the control panel. If standard switches were used, the liquid could cause damage to the switch assembly or various other electrical components. By utilizing the membrane switch 10 of the present invention, this risk is eliminated because the membrane forms a waterproof barrier to the switch. Furthermore, because it is a membrane switch it can withstand the abuse and repeated actuation that such electronic devices are often subjected to when placed in public places. By utilizing this type of membrane switch assembly, the switch can control the various aspects of the juke box itself without having to use a booster switch to accomplish the same thing, thus eliminating the use of unnecessary parts.

It would also be commercially desirable to use this type of membrane switch assembly in various types of video games. Video games are often subjected to the same types of abuses described above. The switches are engaged rapidly and repeatedly and are often exposed to various types of liquid. Again, this type of switch would prevent damage caused by any contact with liquid. It can take the abuse generated by the rapid and repeated switch actuations and finally can control the various components of the electronic device without the use of an additional booster switch. Another commercial product which would benefit from the use of this type of membrane switch is a snow plow controller. Such a controller is provided in the cab of the vehicle that is connected to the plow. Often, this controller is in the form of a joystick. Due to the amperage requirements of the relays and other plow controls, the switches are required to handle high current loads. As such, the incorporation of the present membrane switch facilitates this by providing an easily operable switch which effectively handles the power load.

Those skilled in the art will further appreciate that the present invention may be embodied in other specific forms without departing from the spirit or central attributes thereof. In that the foregoing description of the present invention discloses only exemplary embodiments thereof, it is to be understood that other variations are contemplated as being within the scope of the present invention. Accordingly, the present invention is not limited in the particular embodiments which have been described in detail therein. Rather, reference should be made to the appended claims as indicative of the scope and content of the present invention.

What is claimed is:

1. A switch comprising:

a switch assembly having a switch actuator, and a frame, the frame coupled to the switch assembly;

a first membrane layer; and a second membrane layer, the first and second membrane layers being adhered together with a portion of the switch frame sandwiched between them, wherein a portion of the first membrane layer is engageable with the switch actuator, and a portion of the lower surface of the second membrane layer is coated with an adhesive so that the lower surface of the second membrane layer can be affixed to a surface and support the switch assembly.

2. The switch of claim 1, wherein the switch assembly is capable of carrying a high current.

3. A switch mountable in a casing, comprising:

a membrane, the membrane having an upper surface and a lower surface;

a switch assembly, the switch assembly being attached to the membrane so that movement of the upper surface of the membrane actuates the switch assembly; and an adhesive layer applied to the lower surface of the membrane and couplable to the casing, wherein the coupling of the membrane to the casing supports the switch.

4. The switch of claim 3, further comprising:

a frame, the frame coupled between the switch assembly and the membrane.

5. The switch of claim 4, wherein the membrane has a first layer and a second layer adhered together, wherein a portion of the frame is secured between the first layer and the second layer.

6. The switch of claim 3, wherein the switch actuator is capable of carrying a high current load.

* * * * *